United States Patent [19]

Herron

[11] Patent Number: 4,912,586

[45] Date of Patent: Mar. 27, 1990

[54] ROLLING CLOCK DEVICE

[75] Inventor: Matthew Herron, Menlo Park, Calif.

[73] Assignee: Imagin It Marketing, Inc., San Francisco, Calif.

[21] Appl. No.: 389,083

[22] Filed: Aug. 3, 1989

[51] Int. Cl.[4] ..... G04B 19/00

[52] U.S. Cl. ..... 368/223; 368/228; 368/95; 368/276

[58] Field of Search ..... 368/91, 93–95, 368/224, 223, 276

[56] References Cited

U.S. PATENT DOCUMENTS

| | | | |
|---|---|---|---|
| 2,544,621 | 3/1951 | Stelter | 368/93 |
| 3,025,665 | 3/1962 | Dock et al. | 368/94 |
| 3,458,990 | 8/1969 | Frost | 368/93 |
| 3,492,811 | 2/1970 | Shore | 368/94 |
| 3,533,229 | 10/1970 | Liljequist | 368/95 |

FOREIGN PATENT DOCUMENTS

| | | | |
|---|---|---|---|
| 3135859 | 3/1983 | Fed. Rep. of Germany | 368/93 |
| 1216770 | 3/1986 | U.S.S.R. | 368/93 |

*Primary Examiner*—Bernard Roskoski
*Attorney, Agent, or Firm*—Townsend and Townsend

[57] ABSTRACT

A clock is provided which is movable so as to maintain an indication of local time constantly in a vertically upward position. A shell bears a plurality of time indicia. A clock motor interior to the shell rotates an eccentric weight about the longitudinal axis of the shell, causing the shell to rotate and roll over a support surface. A pointer attached to the clock motor and opposite the eccentric weight points to the proper local time indicia.

26 Claims, 3 Drawing Sheets

ROLLING CLOCK DEVICE

This invention relates to a clock and, in particular, to a clock which rolls or rotates about its axis to maintain an indication of local time in a vertically upward position.

BACKGROUND OF THE INVENTION

Clocks which make some use of gravity are known. An ordinary pendulum clock uses gravity in connection with regulating its periodicity, but displays time typically with a dial device. The device of German Patent DE 3,135,859 works by the force of gravity on a body containing a viscous fluid, and requires supplying an inclined support with timing markings on the support. Previous devices have not provided a clock which continually positions an indicator of local time in a preferred orientation. Previous non-dial, gravity-operated clocks have typically required an extended area for containing and operating the clock. Accordingly, it would be advantageous to provide a clock which rolls or rotates to display local time in a preferred orientation. It would be further advantageous to provide a clock which rotates or rolls within a constrained region.

SUMMARY OF THE INVENTION

The present invention relates to a clock presenting a unique appearance and display. The clock is provided primarily as an entertaining device and an amusement which also provides a time indication.

According to the present invention, a clock or other chronometer includes a movable body having indicia on a multi-planar or non-planar surface. The movable body includes a device for moving the body to a position at which one of the indicia, which corresponds to local time, is positioned in a preferred orientation, preferably vertically upward. The clock includes a shell, preferably with an ovoid, conical, cylindrical, spherical, or polygonal surface. A clock motor mounted in the interior of the shell moves an eccentric weight within the shell, causing the shell to rotate or roll when it is placed on a surface. As the shell rotates or rolls, indicia, such as hour marks, on the exterior of the shell are successively positioned in a vertical location to indicate local time. Preferably, a pointer attached to the motor is visible through a window portion of the shell for pointing to the local time indicium. When the rolling surface has a tapered shape, such as an ovoid or conical shape, the path defined by the rolling clock will be non-linear, and will return to cross itself, thus causing the clock to remain in a defined area. A ring or curved or concave dish can be used to effect or assist in constraining movement of the clock to a confined area.

The clock of the present invention can be provided in a number of forms including a clock which shows a global earth map indicating local time zones, a clock which is conically shaped, and a clock which is a polygon. In one embodiment, the clock is watertight and buouyant so as to float. In another embodiment, the rolling clock is provided so as to rotate a larger ring within which it rotates in a squirrel cage fashion to provide two time indications such as hours and minutes.

DETAILED DESCRIPTION OF THE PREFERRED EMBODIMENT

Figure 1:
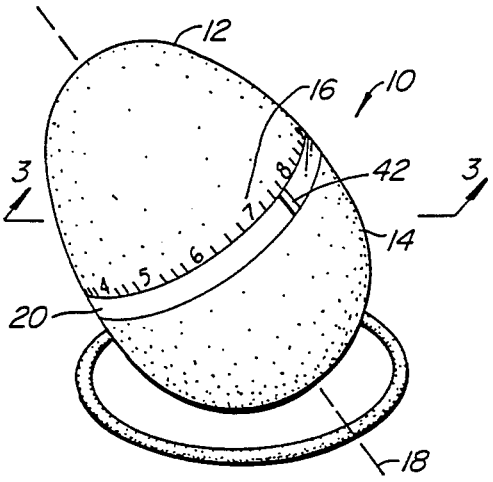
FIG. 1 is perspective view of a rolling clock according to the present invention.
Figure 2:
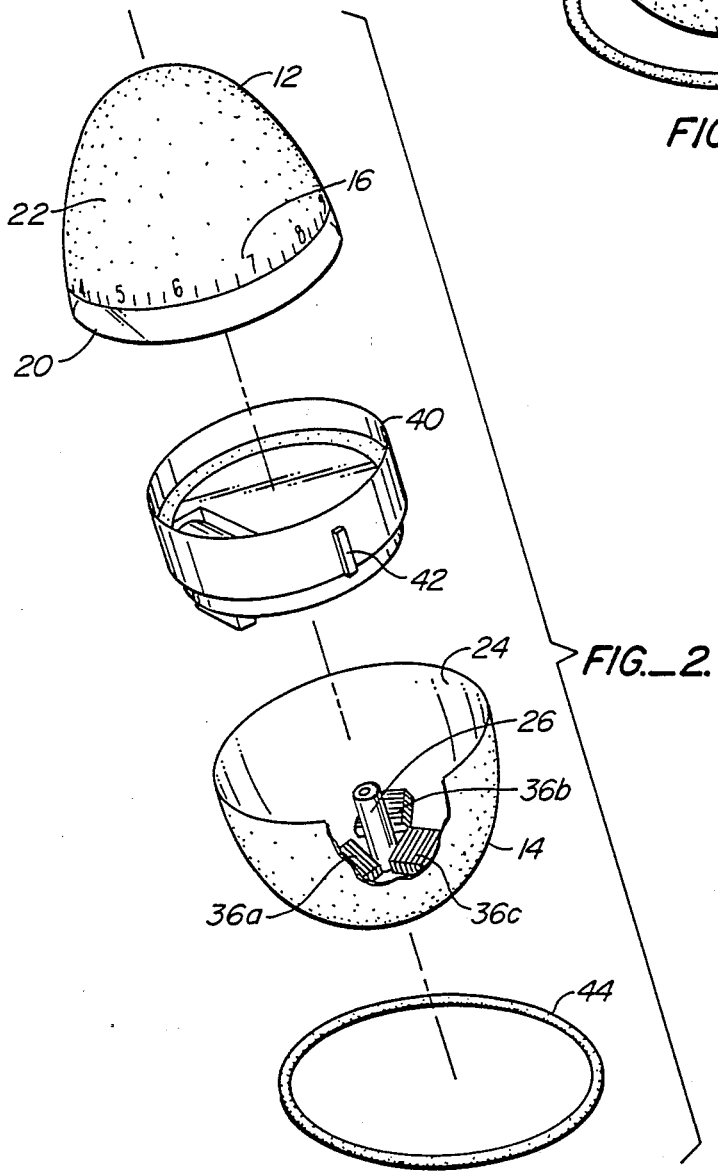
FIG. 2 is an exploded perspective view of the embodiment depicted in FIG. 1.
Figure 3:
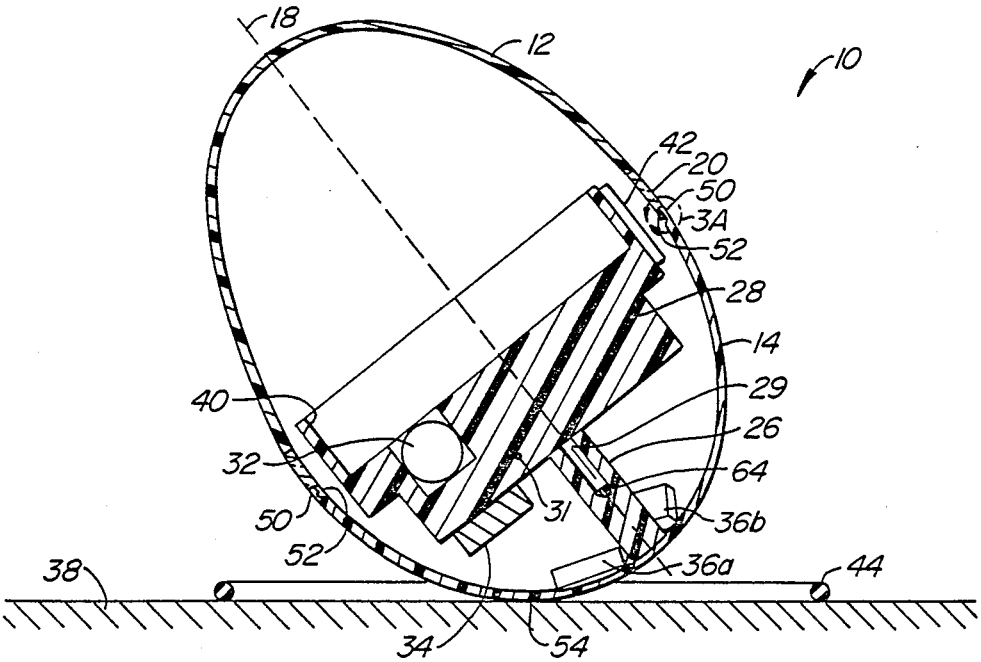
FIG. 3 is a cross-sectional view taken along line 3—3 of FIG. 1.
Figure 3A:
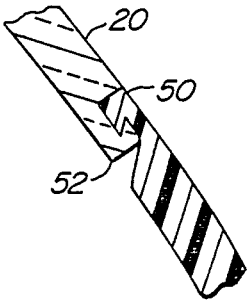
FIG. 3A is a detail of the region of FIG. 3, indicated by detail line 3A.

Referring to FIG. 1, a rolling clock 10, according to the preferred embodiment of the invention, includes an upper shell portion 12 joined to a lower shell portion 14. The upper and lower shell portions 12 and 14 define an ovoid or egg-shaped shell having time indicating indicia 16 positioned around the girth of the shell 12, 14. In the preferred embodiment, the indicia include twelve equally spaced hour indicators, numbered 1–12. Intermediate indicia, such as quarter-hour marks, are preferably included. The ovoid shell defines a longitudinal axis 18. A transparent window 20 is provided in the upper portion of the shell 12 adjacent the indicia 16. As seen in FIG. 2, the shell 12, 14 has an exterior surface 22 and an interior surface 24 which defines the interior region enclosed by the shell 12, 14. A post 26 is attached to the interior surface 24 of the lower portion of the shell 14. As seen in FIG. 3, the clock 28 contains a rotor shaft 29, such as a shaft for rotating an hour hand. The rotor shaft 29 is attached to the post 26, for example by a force-fit. The clock 28 is a conventional clock motor, except that, preferably, the clock 28 runs backwards such that the hour hand shaft 29 rotates once every 12 hours in a counter-clockwise direction, viewed facing the shaft 29. By providing for counter-clockwise motion of the rotor shaft 29, the indicia 16 increase in a direction from left to right. Clock motors which run in a counter-clockwise direction are generally available. Alternatively, a conventional clock motor, such as an electric quartz motor, can be modified to run backwards. The clock 28 has a center of mass which is spaced from the longitudinal axis 18. Spacing of the center of mass from the longitudinal axis 18 is assisted by the placement of the clock battery 32 and, in a preferred embodiment, a lead weight 34. Lead weights **36*a*, 36*b*, 36*c* are also positioned on the interior surface of the lower portion 14** of the shell.

As depicted in FIGS. 1 and 3, when the clock 10 is positioned on a substantially planar surface 38, the longitudinal axis 18 is inclined to the surface 38 because of the balance between the center of gravity 31 of the clock with attached weight and the remainder of the clock, particularly the interior weights 36.

A collar 40 surrounds the clock 28 and is visible through the window 20. A pointer 42 is affixed to the collar 40, preferably in a position opposite the weight 34. In this way, because the weight 34 is always pointing vertically downward, the pointer 42 is always pointing vertically upward. A circular curb 44, which can be, for example, a four-inch diameter rubber O-ring, defines the area of movement of the rolling clock, as described more fully below.

As can be seen from FIG. 3, as the clock motor 28 operates, causing a rotation of the hour-hand rotor shaft 29, such rotation will move the center of gravity of clock 31 (with respect to the shell 12, 14), to pass around the longitudinal axis 18. The force of gravity will, however, maintain the center of gravity 31 in the position depicted in FIG. 3, thus causing any rotation of the rotor shaft 29 to be transmitted, via the post 26 to the shell 12, 14. In this way, the shell 12, 14 will rotate or roll along the support surface 38, causing the clock 10 to move. Because the rotor 29 rotates once every 12 hours, and because the indicia 16 include twelve equally-spaced hour indicators, when the indicia are initially set so that local time is indicated by the vertically upward indicium, as the clock rolls, the indicium indicating correct local time will always be maintained in a vertically upward position. For a similar reason, the pointer 42, which is positioned opposite the weight 34, will also be maintained in a vertically-upward position.

To permit setting the clock to indicate local time, the indicia 16 can be rotated about the longitudinal axis 18 to align the local time indicium with the pointer 42. In the preferred embodiment, the upper shell 12 and lower shell portion 14 are provided in separate releasably engageable parts. To set the clock, the upper portion 12 is releasably disengaged, such as by flexing the upper portion 12 to disengage the engaging lips 50, 52. The upper shell 12 can then be rotated to align the desired indicium 16 with the pointer 42, and the upper shell 12 can be engaged with the lower shell 14.

Figure 8:
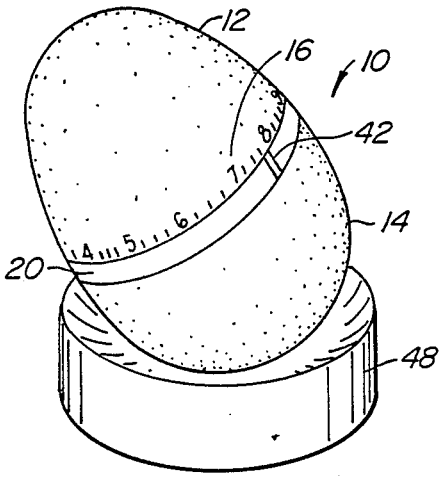
FIG. 8 depicts a clock in a dish.

Because the region of the lower shell 54 which forms the rolling surface for the clock 10 is curved, tapered or angled with respect to a longitudinal axis 18, the path taken by the rolling clock will be nonlinear and will eventually return to cross over itself. In this way, the rolling clock requires only a confined or predetermined surface area upon which to roll. The area on which the clock rolls can further be defined or restrained by use of the curb 44. When a curb 44 is provided, if the rolling clock 10 encounters the curb 44, it will tend to reorient its direction of travel to avoid or move alongside the curb 44. A similar definition of the rolling surface can be provided by a concave dish 48 (FIG. 8), which similarly restrains movement of the rolling clock 10 to the area of the dish 48.

Figure 4:
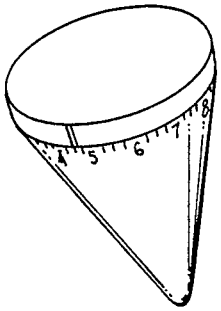
FIG. 4 depicts a rolling clock with a conical rolling surface.
Figure 5:
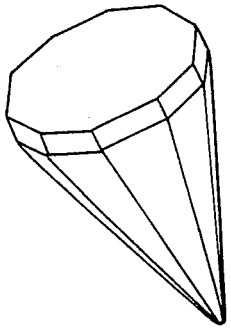
FIG. 5 depicts a rolling clock with a polygonal surface.
Figure 6:
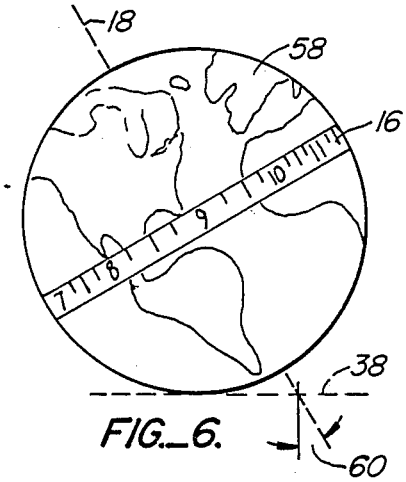
FIG. 6 depicts a spherical rolling clock with a global earth map.

Other configurations having a rolling surface tapered or non-parallel with respect to the longitudinal axis 18 include conical rolling surfaces, as depicted in FIG. 4, polygonal surfaces, as depicted in FIG. 5, and spherical surfaces, as depicted in FIG. 6. The embodiment depicted in FIG. 6 includes a global earth map 58 as part of the rolling clock. In the preferred embodiment, the global earth map 58 is attached to the clock motor 28, and can be viewed through a transparent spherical shell so that it rotates with respect to the hour indicia 16. Alternatively, the global earth map can be provided on the shell 12, 14, and the hour indicia 16 can rotate with respect to the map by being placed on the internal collar 40, to be viewed through the transparent window 30. By providing hour indicia 16, which indicate global time zones, the rotating global earth map 58 can be provided in a form such that the local time in any time zone worldwide is indicated by the respective indicia 16, which are longitudinally aligned with the respective time zones. In a preferred embodiment, the longitudinal axis 18 is disposed at an angle 60 with respect to the vertical, which is equal to the ecliptic angle of about 23.5°.

By providing the rolling clock 10 with a water-tight shell 12, 14, and with sufficient buoyancy, the clock 10 can be configured to float in water so that the time indicia 16 indicating local time will be constantly the indicia which is protruding uppermost from the water. In such a floating embodiment, the shape of the shell 12, 14 is of less importance than in the surface-rolling embodiments discussed above, since the floating clock does not require a rolling surface for engagement with a support plane.

Figure 7:
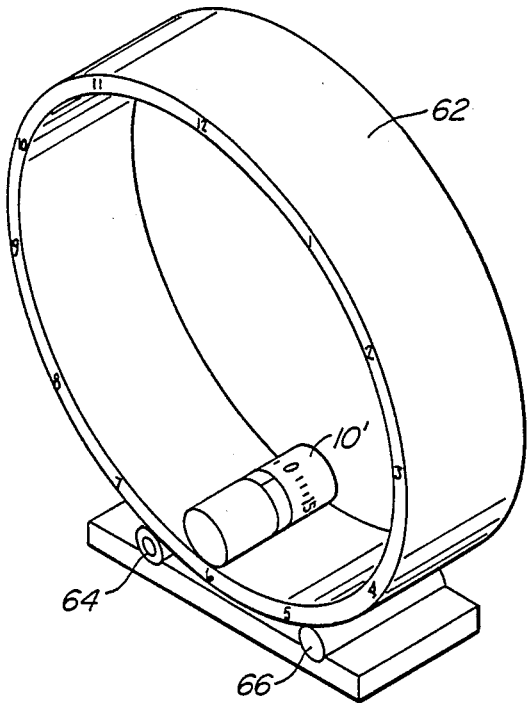
FIG. 7 depicts a cylindrical rolling clock in a squirrel cage bearing second time indicia.

A rolling clock 10 can also be provided with a non-tapering rolling surface, such as a cylindrical rolling surface. When a cylindrical rolling surface is placed on a planar support 38, a substantially linear path of the rolling clock 10 will be defined. In an alternative embodiment, depicted in FIG. 7, the cylindrical rolling clock 10' is positioned in the interior of a rolling squirrel cage-configured ring 62. The ring 62 is supported, for example, on rollers 64, 66, and thus is free to rotate. By providing a predetermined ratio between the diameter of the rolling clock 10' and the ring 62, two time indicia can be provided. The rolling clock 10' can be configured to rotate once per hour, i.e. by connecting the minute-hand rotor of the clock 28 to the post 26. If the diameter of the rolling clock 10' is one-twelfth of the interior diameter of the ring 62, twelve one-hour rotations of the rolling clock 10' will cause one complete revolution of the ring 62. By providing the ring 62 with twelve equally spaced hour indicia and the rolling clock 10' with minute indicia, the apparatus depicted in FIG. 7 can be used to provide an indication both of the hour and minute of local time.

As will be apparent to those skilled in the art, a number of modifications and variations of the invention can be practiced. The local time can be indicated by indicia with an orientation other than vertically upwardly. A motor other than an electric clock motor can be used, such as a spring motor. The clock can be used to indicate other than local time, such as solar time, lunar time, and the like. The clock can be caused to move in discrete, rather than continuous, motion. The indicia can be disposed in a right-to-left increasing fashion if the rotor shaft 29 is caused to rotate in the clockwise direction. The clock or shell can be provided without weights if the clock and shell inherently have the desired weight distribution and mass.

Although the present invention has been described with reference to certain preferred embodiments and variations thereof, other modifications and variations will be apparent to those skilled in the art, the invention being defined by the following claims.

What is claimed is:

1. A clock, comprising:

a shell with a convex rolling surface, the shell having a first axis and defining an interior region;

a motor rotatably attached to said shell along said first axis, said motor having a weight attached in a position which is eccentric with respect to said first axis, wherein rotation of said motor moves said eccentric weight about said axis to effect motion of said shell with respect to a supporting surface; and time-indicating indicia visible from the exterior of said shell, wherein said motion of said shell places one of said indicia in a predetermined position.

2. A clock, as claimed in claim 1, further comprising means for positioning said indicia to place the indicium which corresponds to local time diametrically opposite said weight with respect to said first axis.

3. A clock, as claimed in claim 1, wherein said predefined orientation is a vertically upward orientation.

4. A clock, as claimed in claim 1, further comprising pointing means, movable with respect to said plurality of indicia, for pointing to said one of said plurality of indicia.

5. A clock, as claimed in claim 1, where said motor is an electric motor.

6. A clock, as claimed in claim 1, wherein said motion of said shell on said support surface defines a non-linear path.

7. A clock, as claimed in claim 5, wherein said motion of said shell on said support surface defines a path which crosses itself.

8. A clock, as claimed in claim 1, wherein said support surface is substantially planar.

9. A clock, as claimed in claim 1, wherein said support surface is substantially concave.

10. A clock, as claimed in claim 1, further comprising means for restricting the movement of said body to a predetermined area of said support surface.

11. A clock, as claimed in claim 10, wherein said means for restricting comprises a curb surrounding said predefined area.

12. A clock, as claimed in claim 10, wherein said means for restricting comprises a concave dish.

13. A clock, as claimed in claim 1, wherein said rolling surface is a section of a substantially ovate surface.

14. A clock, as claimed in claim 1, wherein said rolling surface is a section of a substantially spherical surface.

15. A clock, as claimed in claim 1, wherein said shell is substantially spherical and wherein a global earth map is visible through said shell.

16. A clock, as claimed in claim 15, wherein said global earth map defines said first axis as a representation of the earth's rotation axis, and wherein said first axis is inclined with respect to the vertical at about 23.5°.

17. A clock, as claimed in claim 1, wherein said indicia indicate a plurality of global time zones.

18. A clock, as claimed in claim 1, wherein said rolling surface is a section of a substantially conical surface 19. A clock, as claimed in claim 1, wherein said second surface is a section of a substantially cylindrical surface.

20. A clock, as claimed in claim 19, further comprising a ring in a substantially cylindrical shape encircling said clock wherein said motion of said clock provides rotation of said ring.

21. A clock, as claimed in claim 20, wherein said ring contains time-indicating indicia.

22. A clock, as claimed in claim 1, wherein said rolling surface is a section of a substantially polygonal surface.

23. A clock as claimed in claim 1, wherein said clock has sufficient buoyancy to float in water.

24. A clock comprising:

an ovoid shell having a longitudinal axis, an exterior surface and an interior surface defining an interior region;

a post in said interior region attached to said interior surface and extending partially along said longitudinal axis;

a rotating motor positioned in said interior region;

a weight attached to said motor;

means for rotatably attaching said motor and weight to said post, wherein the center of mass of said motor and attached weight are spaced form said longitudinal axis, and wherein rotation of said rotatable motor effects movement of said center of mass about said longitudinal axis to effect rolling motion of said shell when said shell is supported on a surface;

a plurality of time-indicating indicia on said exterior surface, wherein said rolling motion of said shell positions one of said indicia in a vertically upward position to indicate time.

25. A clock, as claimed in claim 24, further comprising:

a pointer operably attached to said clock opposite to said center of mass with respect to said longitudinal axis; and transparent means on said shell for viewing the position of said pointer.

26. A clock, as claimed in claim 22, further comprising means for restricting the movement of said shell to a predetermined area.

* * * * *